US006012630A

United States Patent [19]

Block

[11] Patent Number: 6,012,630

[45] **Date of Patent: *Jan. 11, 2000**

[54] CONTAINER WITH MULTIPLE TRANSVERSE DIVIDERS

[75] Inventor: Steven J. Block, Cincinnati, Ohio

[73] Assignee: Graphic Packaging Corporation, Golden, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/956,958

[22] Filed: Oct. 23, 1997

[51] Int. Cl.[7] ..... B65D 25/04

[52] U.S. Cl. ..... 229/120.17; 229/120.18; 229/120.15; 229/120.29; 206/192

[58] Field of Search ..... 229/120.15, 120.16, 229/120.17, 120.18, 120.08, 120.29; 206/192

[56] References Cited

U.S. PATENT DOCUMENTS

| | | | |
|---|---|---|---|
| 2,175,600 | 10/1939 | Greco | 229/120.18 X |
| 2,271,243 | 1/1942 | Barker . | |
| 2,474,751 | 6/1949 | Morand . | |
| 2,586,886 | 2/1952 | Tyrseck . | |
| 2,660,361 | 11/1953 | Tyrseck . | |
| 2,685,999 | 8/1954 | Forrer . | |
| 2,711,819 | 6/1955 | Vander Lugt, Jr. . | |
| 3,199,762 | 8/1965 | Coons . | |
| 3,300,116 | 1/1967 | Grashege . | |
| 3,845,898 | 11/1974 | Hackenberg . | |
| 4,347,967 | 9/1982 | Loudermilk, Jr. . | |
| 4,418,818 | 12/1983 | Stone . | |
| 4,574,996 | 3/1986 | Brian . | |
| 5,088,641 | 2/1992 | Shepard . | |
| 5,503,273 | 4/1996 | Fiebig et al. . | |

*Primary Examiner*—Gary E. Elkins
*Assistant Examiner*—Tri M. Mai
*Attorney, Agent, or Firm*—Sixbey, Friedman, Leedom & Ferguson, PC; Charles M. Leedom, Jr.; Donald R. Studebaker

[57] ABSTRACT

A compartmented container made from a single blank of material containing a plurality of transverse dividers positioned to receive a single longitudinal partition from the bottom of the carton such that the number of substantially uniform separate cells are doubled. The container may be easily transported in mass quantities either partially assembled or completely unassembled. From its partially assembled state, the container can be fully erected with minimal post-shipping assembly activities which do not increase regardless of the number of compartments to be contained within the container.

26 Claims, 4 Drawing Sheets

CONTAINER WITH MULTIPLE TRANSVERSE DIVIDERS

BACKGROUND OF THE PRESENT INVENTION

1. Field of the Invention

The present invention generally relates to compartmented containers made from a single blank of material and specifically to a container wherein a plurality of transverse dividers are positioned to receive at least one partition from the bottom of the carton such that the number of compartments made by the transverse dividers is doubled.

2. Discussion of Related Art

Compartmented containers capable of securely carrying a wide assortment of inventory have been manufactured for many years. For economic reasons, single blank compartmented containers which require the least number of cutting, scoring and folding operations have become the industry standard. Manufacturers have further determined that retailers prefer pre-assembled containers which are easy to ship from the manufacturer and require minimal post-shipping assembly to complete erection of the container. As profit margins continue to narrow, retailers want the capacity to securely ship increasingly more parts per container without a corresponding increase in post-shipping assembly activities necessary to erect the containers.

Early containers similar to that disclosed in U.S. Pat. No. 3,300,116 to Grashege, formed compartments when one or more sidewalls folded into the bottom of the carton and two dividers perpendicular to the sidewalls with slots positioned along the entire length to accept the sidewalls were inserted from the top. Aside from the reality that these containers required an inordinate number of cutting, scoring, and folding operations is the fact that a relatively high per unit cost resulted from the container's design that required multiple surfaces of the container to be formed from overlapping and redundant panels. Even though this container permitted the manufacturer to ship the pre-erected carton in a fully collapsed and flat position, it required a considerable post-shipping assembly process prior to final erection of the container.

In an effort to overcome the shortcomings of this compartmented container, U.S. Pat. No. 5,088,641 to Shepard discloses a container made from a single blank, with multiple cells formed by a transverse divider located at the bottom of the carton. The reference further discloses the capability of this design to support additional compartments by adding an additional divider inserted from the bottom. This particular design clearly resulted in a container that required less material to construct and a reduced effort to erect the finished container. The six, eight and ten-compartment embodiments however, required an increasingly larger number of post-shipping assembly operations prior to final erection of the container.

Clearly there is a need for a compartmented container that provides an increased number of compartments without also requiring a concomitant increase in the post-shipping assembly effort necessary to erect the container.

SUMMARY OF THE INVENTION

In view of the foregoing, it is the primary object of the present invention is to overcome the disadvantages associated with the compartmented containers disclosed in the prior art. Specifically, it is an object of the present invention to provide a compartmented container with a plurality of transverse dividers that provide an increased number of compartments over that found in the prior art.

It is another object of the present invention to provide a compartmented container with a plurality of transverse dividers wherein the multiple transverse dividers are formed prior to shipping.

It is a further object of the present invention to provide a compartmented container with a plurality of transverse dividers that is also easy to ship.

It is yet a further object of the present invention to provide a compartmented container with a plurality of transverse dividers wherein the multiple transverse dividers automatically erect upon post-shipping erection of the container.

It is a still further object of the present invention to provide a compartmented container with a plurality of transverse dividers that is easily adaptable to accommodate additional transverse dividers to suit variously sized contents.

It is another object of the present invention to provide a compartmented container with a plurality of transverse dividers that supports the addition of more transverse dividers without requiring any additional post-shipping assembly operations prior to final erection of the container.

These as well as additional objects of the present invention are achieved by forming a multiple compartment container movable between a folded flat position and an open position comprising at least two transverse dividers, three joining tabs, a front panel, a back panel, two side panels, a bottom panel, and a longitudinal divider. The container is formed from a single blank that may be easily transported in mass quantities either partially assembled or completely unassembled. From its partially assembled state, the container can be fully erected with minimal post-shipping assembly activities which do not increase regardless of the number of compartments to be contained within the container.

The various features, objects and advantages of the present invention will become apparent from the following Brief Description of the Drawings and Detailed Description of the Invention.

DETAILED DESCRIPTION OF THE PRESENT INVENTION

Figure 1:
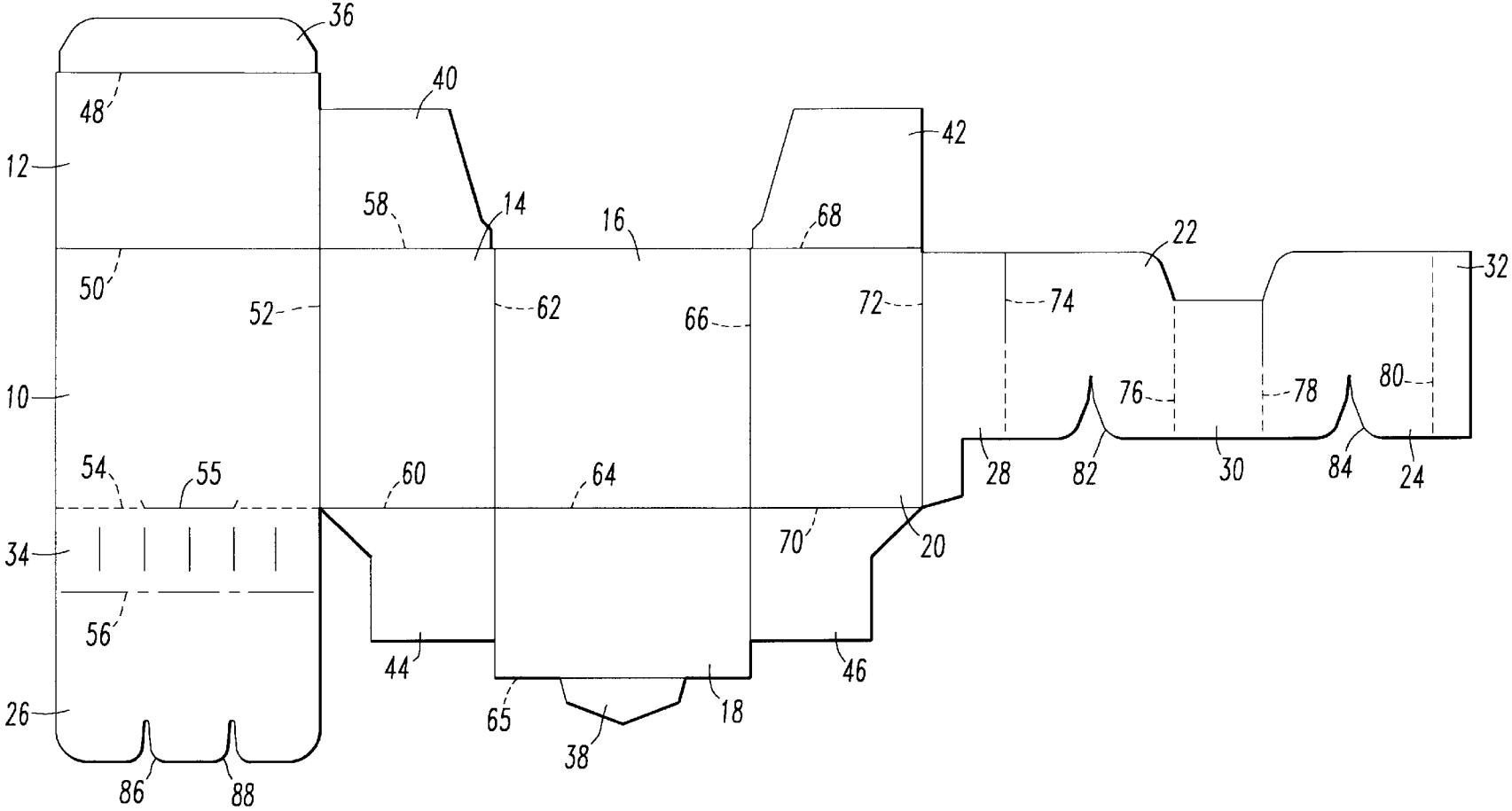
FIG. 1 shows a single blank for forming a multiple compartment container in accordance with the present invention in a cut and unassembled condition.

A blank 1 for forming a compartmented container according to the present invention is illustrated in FIG. 1 and includes: a back panel 10; a top panel 12; a side panel 14;

a front panel 16; a bottom panel 18; and a side panel 20, which together form the outside envelope of the container. Additionally, the container blank includes a first transverse divider 22; a second transverse divider 24; and a longitudinal divider 26 which divide the inside of the container into compartments wherein respective parts may be positioned. The container also includes joining tabs 28, 30 and 32; a bottom tab 34, a top flap 36; a locking tab 38; top side flaps 40 and 42; and bottom side flaps 44, and 46 which interconnect the panels and dividers, and hold parts within the container. Joining tabs 28 and 30 space first transverse divider 22 and second transverse divider 24, respectively, from side panel 20 as well as providing a surface upon which adhesive may be placed to assemble the carton. Joining tab 32 provides a surface upon which adhesive may be placed to attach the second transverse divider to back panel 10. Bottom tab 34 spaces the longitudinal divider 26 equally between the front panel 16 and back panel 10.

Scores are formed in the container to ease assembly thereof. Thus, the container further includes: a score 48 between top flap 36 and top panel 12; a score 50 between top panel 12 and back panel 10; a score 52 between back panel 10 and side panel 14; a score 54 between back panel 10 and bottom tab 34; a score 56 between bottom tab 34 and longitudinal divider 26; a score 58 between top side flap 40 and side panel 14; a score 60 between bottom side flap 44 and side panel 14; a score 62 between side panel 14 and front panel 16; a score 64 between front panel 16 and bottom panel 18; a score 65 between bottom panel 18 and locking tab 38; a score 66 between front panel 16 and side panel 20; a score 68 between top side flap 42 and side panel 20; a score 70 between bottom side flap 46 and side panel 20; a score 72 between side panel 20 and joining tab 28; a score 74 between joining tab 28 and first transverse divider 22; a score 76 between first transverse divider 22 and joining tab 30; a score 78 between joining tab 30 and second transverse divider 24; a score 80 between second transverse divider 24 and joining tab 32. These scores insure that the container folds properly and reduce the force required to fold the container sections.

As illustrated in FIG. 1, first transverse divider 22 and second transverse divider 24 include flared slots 82 and 84, respectively, and longitudinal divider 26 includes flared slots 86 and 88. To partially assemble container, joining tabs 28 and 32 are affixed to the back panel 10 and joining tab 30 is affixed to the front panel 16 using an adhesive. The container is then folded flat in the position illustrated in FIG. 2. In this position, a large number of containers may be stored in a relatively small volume and economically shipped.

Figure 2:
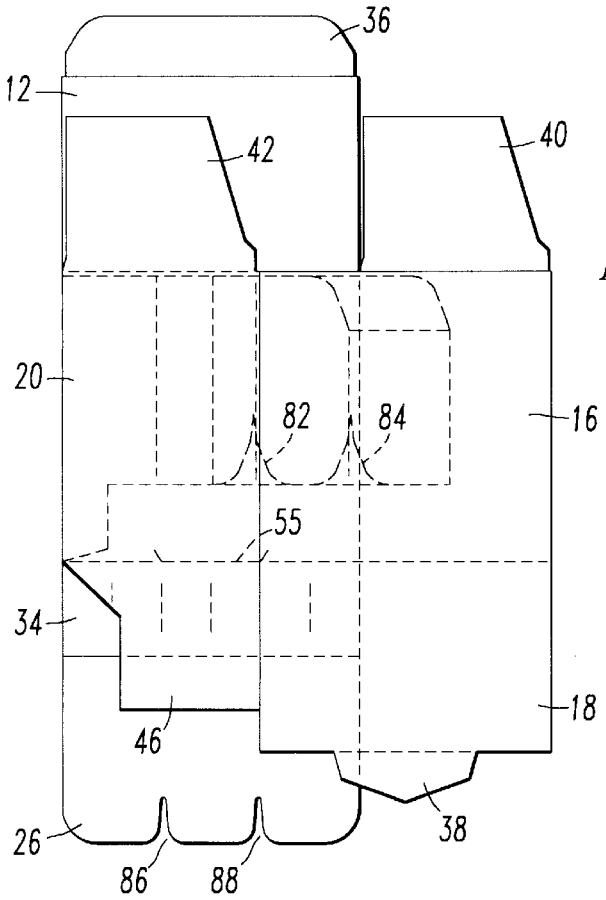
FIG. 2 illustrates the container of the present invention partially assembled and folded flat.

When the container is folded flat for shipment, as illustrated in FIG. 2, side panel 20, front panel 16, bottom panel 18, top side flap 42, bottom side flap 46, and locking tab 38 will have their exterior container surface exposed and facing upwardly. Additionally, a portion of top panel 12, a portion of longitudinal divider 26, a portion of bottom tab 34, top flap 36, top side flap 40 will have their interior container surface exposed and facing upwardly. Furthermore, transverse dividers 22 and 24 as well as joining tabs 28, 30, and 32 are will be completely concealed.

Figure 3:
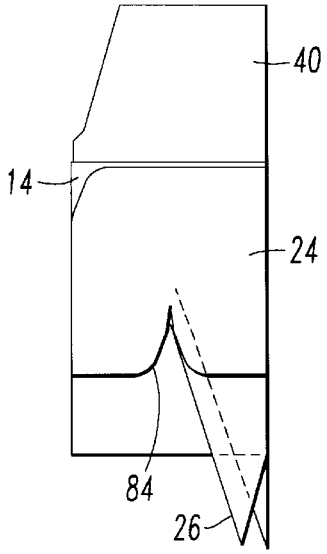
FIG. 3 is a sectional view of the dividers of the container of the present invention.
Figure 4:
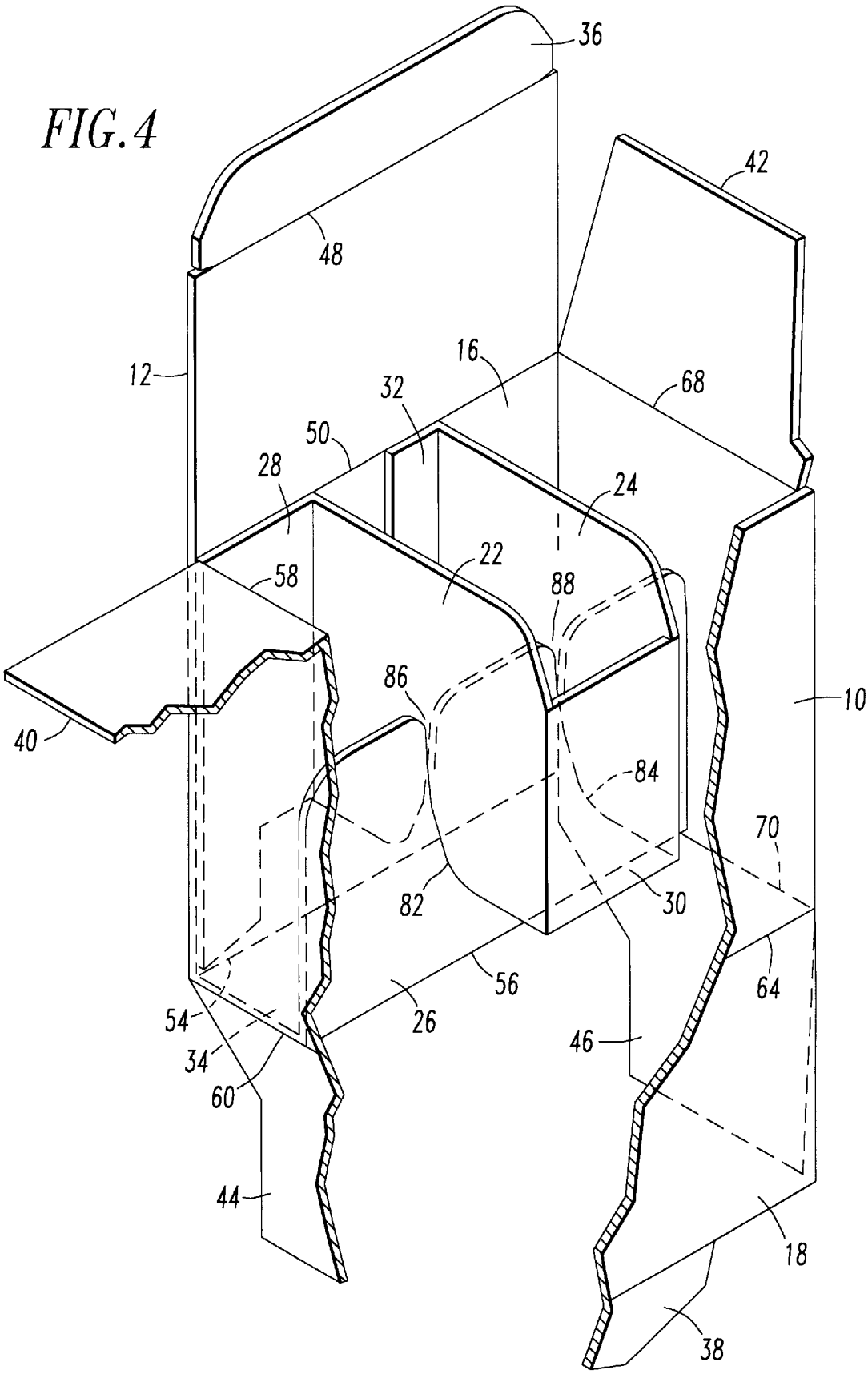
FIG. 4 is a cutaway view of the interior of the container showing the position of the first and second transverse dividers and the longitudinal divider when the container is initially erected.

When the container is unfolded from the flat shipping position (FIG. 2) to the open positions of FIG. 3 and FIG. 4, transverse dividers 22 and 24 are positioned substantially perpendicular to front and back panels 10 and 16, respectively, longitudinal divider 26 is pushed up into flared slots 82 and 84 such that flared slots 86 and 88 receive transverse dividers 22 and 24. Bottom tab 34 will thus be positioned below score 54. Bottom side flaps 44 and 46 are then folded on scores 60 and 70, respectively, such that they are positioned below score 56 of longitudinal divider 26. Bottom panel 18 is then folded on score 64 to a position adjacent to bottom side flaps 44 and 46, with locking tab 38 being inserted through the locking tab slot 55 provided in score 54 of the bottom tab 34 such that parts placed within container will be secured therein.

To close the container, top side flaps 40 and 42 are folded on scores 58 and 68, respectively, such that they are positioned above the top edge of transverse dividers 22 and 24. Top panel 12 is then folded on score 50 and top flap 36 is folded along score 48. Top panel 12 is then positioned to cover top side flaps 40 and 42, with top flap 36 being inserted inside the container between top side flaps 40 and 42 and front panel 16. The container thus forms a self contained enclosure having six interior cells wherein parts may be securely held.

Figure 5:
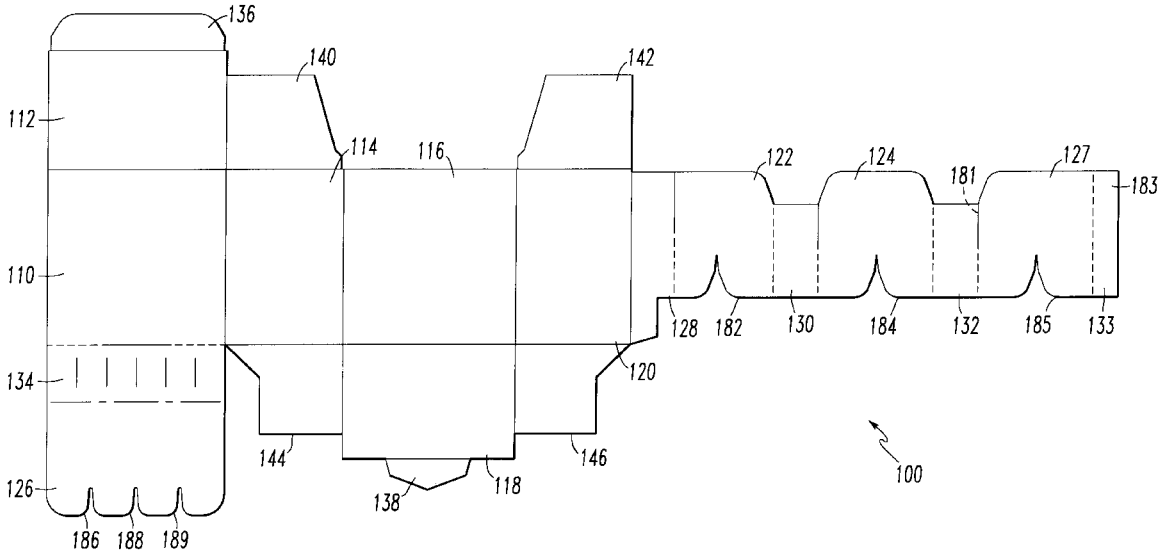
FIG. 5 shows a single blank for forming a multiple compartment container in accordance with an alternative embodiment of the present invention in a cut and unassembled condition.

Referring now to FIG. 5, an alternate embodiment (eight cell container) of the present invention will be described in greater detail. As with the container illustrated in FIG. 1, the container 100 includes: a back panel 110; a top panel 112; a side panel 114; a front panel 116; a bottom panel 118; and a side panel 120, which together form the outside envelope of the container. In addition to including a first transverse divider 122; a second transverse divider 124; and a longitudinal divider 126, this embodiment also includes a third transverse divider 127 to further divide the inside of the container into even more compartments wherein respective parts may be positioned. The container also includes joining tabs 128, 130, 132, and 133; a bottom tab 134, a top flap 136; a locking tab 138; top side flaps 140 and 142; and bottom side flaps 144, and 146. Joining tabs 128, 130, and 132 space first transverse divider 122, second transverse divider 124, and third transverse divider 127, respectively, from side panel 120 as well as providing a surface upon which adhesive may be placed to assemble the carton. Joining tab 133 provides a surface upon which adhesive may be placed to attach the third transverse divider to back panel 110.

In addition to the scores formed in the container of FIG. 1, the container of FIG. 5 further includes a score 181 between third joining tab 132 and third transverse divider 127; and a score 183 between third transverse divider 127 and fourth joining tab 133. In addition to the two flared slots 186 and 188 which are similar to those found in the longitudinal divider of FIG. 1, the longitudinal divider 126 in FIG. 5 also includes a third flared slot 189 for receiving flared slot 185 found in third transverse divider 127. Thus, when an eight cell container is assembled, the additional transverse divider would be received in the additional flared slot and it would be oriented generally perpendicular to transverse divider 124 when divider 124 is received in flared slot 188. To partially assemble container, joining tabs 128, and 132 are affixed to the back panel 110 and joining tabs 130 and 133 are affixed to the front panel 116 using an adhesive. The container is then folded flat in the position similar to that illustrated in FIG. 2. Full assembly and closure of the container is identical to that in the container of FIG. 4. Numerous transverse dividers can be added in similar fashion to form any even number of compartments without increasing the dimensions of the container. It should be equally obvious to one skilled in the art that by increasing the dimensions of the front and back panels, an unlimited number of transverse dividers can be added to the container without significantly increasing the activity required to assemble the container.

It can thus be seen that a compartmented container is illustrated which includes dividers for forming cells therein and avoids the problems of the prior art wherein an increasing amount of post-shipping assembly activity is necessary as the number of contained compartments increases. While the present invention has been described in reference to preferred embodiments, it will be appreciated by those skilled in the art that the invention may be practiced otherwise than as specifically described herein without departing from the spirit and scope of the invention. Therefore, it is understood that the embodiments shown in the drawings and described above are merely for illustrative purposes and is not intended to limit the scope of the invention, which is defined by the following claims.

What is claimed is:

1. A multiple compartment container, movable between a folded flat position and an open position, comprising:

a back panel having top, bottom and side edges and at least one longitudinal divider attached to a bottom tab which is attached to said bottom edge of said back panel;

a first transverse divider having top, bottom and side edges, one of said side edges of said transverse divider abutting said back panel intermediate the edges of said back panel;

a first side panel and an adjacent first joining tab attached to and extending from said first side panel and joining said first transverse divider at a point spaced from said first side panel;

said at least one longitudinal divider is folded up into engagement with said first transverse divider when said container is fully assembled;

at least a second transverse divider having top, bottom and side edges, one of said side edges of said second transverse divider abutting said back panel intermediate the edges of said back panel;

a second joining tab attached to and extending from said first transverse divider and joining said second transverse divider at a point spaced from said first transverse divider; and a third joining tab attached to and extending from said second transverse divider wherein said third joining tab is affixed to said back panel;

wherein said longitudinal divider extends upwardly into the container when contents are placed therein to form the multiple compartment container.

2. The multiple compartment container as defined in claim 1, further including a front panel adjacent said first side panel, a second side panel adjacent said front panel and said back panel, a top panel, and a bottom panel.

3. The multiple compartment container as defined in claim 2, wherein said first joining tab is affixed to said back panel, and said second joining tab is affixed to said front panel.

4. The multiple compartment container as defined in claim 3, further including two bottom side flaps foldably connected to said bottom edges of said first and second side panels, said bottom side flaps being folded inwardly at right angles to each other prior to said bottom panel being folded over said bottom side flaps when said container is partially closed.

5. The multiple compartment container as defined in claim 4, further including two top side flaps foldably connected to said top edges of said first and second side panels, said top side flaps being folded inwardly at right angles to each other prior to said top panel being folded over said top side flaps when said container is completely closed.

6. The multiple compartment container as defined in claim 5, wherein said bottom panel includes a bottom flap extending from said top edge of said bottom panel as a means for maintaining said bottom panel in close parallel relationship with said two bottom side flaps when the container is closed.

7. The multiple compartment container as defined in claim 5, wherein said top panel includes a top flap extending from said top edge of said top panel as a means for maintaining said top panel in close parallel relationship with said two top side flaps when the container is closed.

8. The multiple compartment container as defined in claim 7, wherein said first transverse divider and said first joining tab are folded flat against said back panel and said second side panel in said folded flat position.

9. The multiple compartment container as defined in claim 8, wherein said second transverse divider and said second joining tab are folded flat against said front panel and said first side panel in said folded flat position.

10. The multiple compartment container as defined in claim 9, wherein said longitudinal divider is folded up into engagement with and oriented at an angle less than 180° with respect to said first transverse divider when said container is fully assembled.

11. The multiple compartment container as defined in claim 10, wherein a width of said longitudinal divider is substantially equal to a width of said front and back panels.

12. The multiple compartment container as defined in claim 11, wherein a length of said longitudinal divider is of reduced length relative to a length of said top, bottom and side panels.

13. The multiple compartment container as defined in claim 12, wherein said longitudinal divider includes at least one slot extending downward from said top edge thereof, said slot being wider at said top edge and narrowing to an apex located intermediate said top and bottom edge of said longitudinal divider.

14. The multiple compartment container as defined in claim 13, wherein a number of slots in said longitudinal divider equal a number of transverse dividers found therein.

15. The multiple compartment container as defined in claim 14, wherein a width of said transverse dividers is substantially equal to a width of said first and second side panels.

16. The multiple compartment container as defined in claim 15, wherein a length of said transverse dividers are of reduced length relative to a length of said top, bottom and side panels.

17. The multiple compartment container as defined in claim 16, wherein said transverse dividers include at least one slot extending upwardly from said bottom edge thereof, said slot being wider at said bottom edge and narrowing to an apex located intermediate said top and bottom edge of said transverse divider.

18. The multiple compartment container as defined in claim 17, wherein a number of slots in said transverse divider equals a number of longitudinal dividers found therein.

19. The multiple compartment container as defined in claim 18, wherein a width of said joining tabs is substantially determined by a desired number of equally spaced transverse dividers to be constructed in the blank.

20. The multiple compartment container as defined in claim 19, further including a locking tab affixed to said bottom panel.

21. The multiple compartment container as defined in claim 20, further including a slit located in a fold line between said bottom tab and said back panel configured to receive said locking tab to close the container.

22. The multiple compartment container as defined in claim 21, further including:

a third transverse divider having top, bottom and side edges, one of said side edges of said third transverse divider abutting said front panel intermediate the edges of said front panel;

a third joining tab attached to and extending from said second transverse divider and joining said third transverse divider at a point spaced from said second transverse divider; and a fourth joining tab attached to and extending from said third reverse divider wherein said fourth joining tab is affixed to said front panel.

23. A blank for forming a multiple compartment container, comprising:

a back panel having top, bottom and side edges and a longitudinal divider attached to a bottom tab which is attached to an edge of said back panel;

a front panel having a top, bottom and side edges attached to a first side panel having top, bottom and side edges which in turn is attached to a side edge of said back panel;

a first joining tab having a top, bottom, and side edges attached to a second side panel having top, bottom, and side edges which in turn is attached to another side edge of said front panel;

a first transverse divider having top, bottom and side edges which in turn is attached to a side edge of said first joining tab and a second joining tab having top, bottom and side edges attached to a side edge of said first transverse divider; and at least a second transverse divider having top, bottom and side edges which is attached to a side edge of said second joining tab;

wherein said longitudinal divider extends upwardly into the container when contents are placed therein to form the multiple compartment container.

24. The blank as defined in claim 23, further including a top panel adjacent said back panel and a bottom panel adjacent said front panel.

25. The blank as defined in claim 24, further including a bottom tab attached to and extending from said bottom edge of said back panel and joining said longitudinal divider at a point spaced from said bottom edge of said back panel.

26. The blank as defined in claim 25, further including a third joining tab having top, bottom and side edges attached to said second transverse divider.

* * * * *